US006837079B1

(12) United States Patent
Takeuchi

(10) Patent No.: US 6,837,079 B1
(45) Date of Patent: Jan. 4, 2005

(54) WARP KNITTED FABRIC FOR AIR BELT COVER

(75) Inventor: Hiroyuki Takeuchi, Shiga (JP)

(73) Assignee: Takata Corporation, Tokyo (JP)

( * ) Notice: Subject to any disclaimer, the term of this patent is extended or adjusted under 35 U.S.C. 154(b) by 0 days.

(21) Appl. No.: 09/328,890

(22) Filed: Jun. 9, 1999

(30) Foreign Application Priority Data

Jun. 9, 1998 (JP) ..... H10-160778
Jun. 9, 1998 (JP) ..... H10-160779

(51) Int. Cl.[7] ..... D04B 21/16; B60R 21/18
(52) U.S. Cl. ..... 66/198; 280/733
(58) Field of Search ..... 66/198, 169 R, 66/170, 196, 171, 202; 280/733, 728.1, 729, 730.1, 730.2, 742

(56) References Cited

U.S. PATENT DOCUMENTS 5,385,367 A * 1/1995 Tanaka et al. ..... 66/198
5,390,953 A 2/1995 Tanaka et al. ..... 280/733
5,682,771 A * 11/1997 Forest et al. ..... 66/198
5,692,777 A 12/1997 Tochacek et al. ..... 280/43.1
6,082,763 A * 7/2000 Kokeguchi ..... 280/733

FOREIGN PATENT DOCUMENTS

EP 0 904 993 A2 3/1999
JP 11-78775 3/1999

* cited by examiner

*Primary Examiner*—Danny Worrell
(74) *Attorney, Agent, or Firm*—Foley & Lardner LLP

(57) ABSTRACT

A warp knitted fabric is for enclosing a pouched belt constituting an inflatable air belt and folded into a shape of a belt. The warp knitted fabric has good stretching characteristics, strength and comfortableness. The warp knitted fabric includes a knitting yarn 20 and an additional yarn 30 inserted into the knitting yarn 20. The thickness of the additional yarn 30 is 3000 d or below, and the thickness of the knitting yarn 20 is the same or below that of the additional yarn.

19 Claims, 6 Drawing Sheets

WARP KNITTED FABRIC FOR AIR BELT COVER

FIELD OF THE INVENTION

This invention relates to a knitted fabric for covering an inflatable belt for an air belt system which is so constructed that a part of the seat belt is in a shape of a bag or an envelope and is inflatable with gas from a gas generator for protecting a passenger in the event of collision.

BACKGROUND

As this kind of air belt system, this applicant has disclosed an air belt system comprising an inflatable air belt, a gas generator for supplying gas into the air belt, the air belt including a pouched belt folded into the shape of a band and a cover for enclosing the pouched belt, wherein the cover can hardly stretch in the direction of the length, but can stretch in the direction of inflation of the air belt, and the stretch of the air belt in the direction of inflation shortens the longitudinal length of the air belt. (Japanese Patent Application No. 9-236903. Hereinafter referred to as the prior application.)

Referring now to drawings, the air belt system of the prior application will be illustrated. FIG. 1*a* is a perspective view of the interior of an automotive vehicle provided with the air belt of the prior application. FIG. 2*a* is a plan view of an shoulder belt and an lap belt illustrating near the coupled portion thereof. FIG. 2*b* is a plan view of a pouched belt; FIGS. 2*c,* 2*d,* and 2*e* are cross sectional views taken along lines C—C, D—D, and E—E of FIG. 2*a* respectively. FIG. 3*a* is a plan view of a shoulder belt with the air belt inflated, FIG. 3*b* is a plan view of a pouched belt in the state of being inflated, and FIGS. 3*c* and 3*d* are cross sectional views taken along lines C—C and D—D of FIG. 3*a,* respectively. FIG. 4 shows how to knit the air belt cover.

The air belt system 1 comprises a shoulder belt 2 extending diagonally across the passenger from the right side to the left side thereof, a lap belt 3 extending from the right side to the left side of the passenger, a buckle unit 4 disposed on the floor of the vehicle body or the like, a tongue 5 for being inserted into and engaged with the buckle unit 4 when the belt is to be fastened, and an intermediate guide 6 for guiding the shoulder belt 2.

The shoulder belt 2 is composed of a webbing 2A made of a normal belt which is of the same material as that for generally used conventional seat belts and an air belt 2B connected to one end of the webbing 2A. The webbing 2A is slidably drawn through the intermediate guide 6. The other end of the webbing 2A is coupled to a seat belt retractor (ELR) having a collision lock feature fixed to the vehicle body. The seat belt retractor 7 is adapted to wind up the webbing 2A.

The air belt 2B is so located as to be in contact with the passenger, and a tongue 5 is secured to the end thereof opposite the webbing 2A.

The lap belt 3 is made of a normal webbing which is of the same material as generally used a seat belt and coupled to the tongue 5 on one end and to a seat belt retractor (ELR) 8 fixed to the vehicle body on the other end. The buckle unit 4 further includes a gas generator 9 coupled thereto, which actuates and generates high pressure gas in case of emergency such as collisions.

The tongue 5 and the buckle unit 4 are provided with passages for allowing gas to pass from the gas generator 9 to the air belt 2B.

As shown in FIG. 2 and FIG. 3, the air belt 2B comprises an inflatable belt 10 and a tubular knit cover 12 enclosing the belt 10. The belt 10 is so shaped that the part coming on the chest and belly of the seated passenger is wider, and the wider part is to be folded into an elongated belt. Numeral 11 represents seams of the belt 10.

The knit cover 12 is flexibly expandable widthwise but can hardly stretch in the direction of the length. FIGS. 4*a* and 4*b* illustrate how to knit this knit cover, respectively.

FIG. 4*a* shows a normal warp knitted fabric comprising a knitting yarn 20, wherein a plurality of knitting yarns 20 (20A–20D) constitute loops R. Each loop is arranged in a staggered format to the right and left from top to bottom of the drawing. The tip portion of each loop R (for example, the tip portion of the loop $R_{B2}$) is placed around the base of the adjacent loop (for example, the base of the loop $R_{A1}$), and around the base thereof, the tip portion of the adjacent loop (for example, the tip of the loop $R_{A3}$) is placed. Therefore, the loops R are arranged successively in row from top to bottom of the drawing, and loops made of the yarn coming from the right side and the loops made of the yarn coming from the left side are arranged alternately from top to bottom in one row; they are arranged from the top in the order of $R_{A1}$, $R_{B2}$, $R_{A3}$, and so on.

FIG. 4*b* illustrates the fabric strengthened by adding additional yarns 30 to the knitting yarns 20, which thereby can be made thinner. The additional yarn 30 is inserted along a series of loops arranged from top to bottom passing through the intersections of the knitting yarns 20 alternately from the front to the back and again from the back to the front, and so on.

The air belt 2B and the lap belt 3 are both coupled to the tongue. The knit cover 12 is so constructed as to undergo the tensile load exerted to the air belt by being coupled to the webbing 2A and the tongue 5.

When the gas generator 9 is actuated in the state that the tongue 5 is engaged with the buckle unit 4, the air belt inflates. In this case, the length of the knit cover 12 along the length of the air belt 2B will be shortened, so that the air belt 2B will be brought into intimate contact with the passenger to ensure the significant protection of the passenger.

FIG. 5 shows the state that the knit cover 12 of warp knitted fabric using additional yarns as shown in FIG. 4*b* shortens in its longitudinal length when the air belt 2B (pouched belt 10) is inflated. As described above, the knit cover 12 can hardly stretch in the direction of the length of the belt due to the application of heat drawing processing. When the pouched belt 10 is inflated, the knitted loops of the knit cover 12 expand in the direction of the width, and as a result, the knit cover 12 contracts in the direction of the length, and therefore the longitudinal length of the air belt 2B will be shortened.

In the present air belt unit, when the gas generator actuates and the air belt is inflated, the cover expands as well. Since the cover can hardly stretch in the direction of the length of the air belt, the length thereof will be shortened when the air belt is inflated. Consequently, the length of the air belt will also be shortened so that the air belt is well fitted to the passenger to ensure the protection of the same.

The knit cover of the air belt system of aforementioned prior application requires specific stretching characteristics such that it can hardly stretch in the direction of the length of the air belt, but can stretch in the direction of the expansion of the air belt and thereby be shortened in length in the direction of the length of the air belt when the air belt is inflated, as well as a sufficient strength and superior comfortableness.

OBJECT AND SUMMARY OF THE INVENTION

An object of the present invention is to provide a warp knitted fabric for the air belt cover having desirable and superior stretching characteristics as well as sufficient strength and superior comfortableness.

An another object of the present invention is to provide a warp knitted fabric for the air belt cover in which the knitted loops expand only when the air belt is inflated and can hardly expand in normal circumstances.

The warp knitted fabric for the air belt cover of the first aspect of the present invention is intended for covering a bag belt which is constituting an inflatable air belt and is folded into the shape of a band. The warp knitted fabric for the air belt cover has a knitted yarn and an additional yarn inserted thereto. The thickness of the additional yarn in denier is 3000 denier (d) or lower, and the thickness of the knitting yarn is equivalent to or below that of the additional yarn.

In the warp knitting yarn for the air belt of the present invention, desirable stretching characteristics, strength, and comfortableness may be accomplished by using the additional yarn of 3000 d or below in thickness and the knitting yarn of the same thickness or below to adequately control the tensile strength exerted in the direction of the length (course) caused by the expansion in the direction of the width (wale) as a result of inflation.

Preferably, the knitting yarn and the additional yarn are made of thermoplastic synthetic filament yarns having base yarn strength of at least 8.0 g/d in order to obtain sufficient strength.

The additional yarn is preferably a double yarn composed of two yarns having fine filaments of about 5 to 10 denier each. By using such fine and soft yarns in closely touched state, a thin and soft air belt cover with a nice texture may be obtained.

The warp knitted fabric for the air belt cover of the second aspect of the present invention is intended for covering a pouched belt constituting a inflatable air belt and folded into the shape of a band, characterized in that the warp knitted fabric for the air belt cover comprises knitted yarns and additional yarns inserted thereto, in that the additional yarns comprise a first additional yarn which is relatively thick for preventing stretch of the warp knitted fabric in the direction of the length and a second additional yarn which is relatively thin for preventing stretch of the warp knitted fabric in the direction of the width, and in that the warp knitted fabric is allowed to be stretched by a breakage of the second additional yarn.

In the warp knitted fabrics in the present invention, the second additional yarn prevents the knitted loops from expanding when the belt is not inflated. Since the second additional yarn is easily broken when the air belt is inflated, it will not inhibit expansion of the air belt.

Preferably, in the present invention, the knitting yarn constitutes loops successively and engages alternately with the adjacent loops on the right side and on the left side, and the first additional yarn establishes a link between the loops of the closest knitting yarns, and the second additional yarn established a link between loops of the next closest knitting yarns.

According to the present invention, the thickness of the second addition yarn is preferably 300 denier (d) or below, and the thickness of the first additional yarn ranges from 1000 d to 3000 d, and the thickness of the knitting yarn is equivalent to or below that of the first additional yarn. It is further preferable that the knitting yarn and the first additional yarn are made of thermoplastic synthetic filaments with the base yarn strength of at least 8.0 g/d.

DETAILED DESCRIPTION OF THE PREFERRED EMBODIMENTS

A preferred embodiment of the first aspect of the present invention will be described.

Figure 1B:
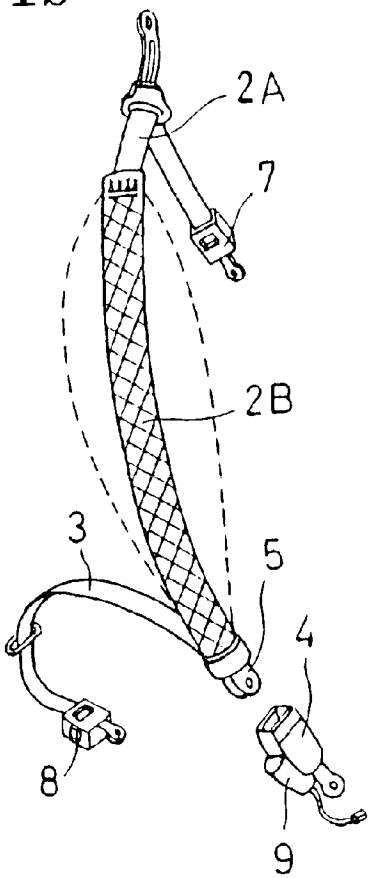
FIGS. 1*a* and 1*b* are a perspective view of the seat provided with an air belt system related to the prior application and a perspective view of the air belt system respectively.
Figure 1A:
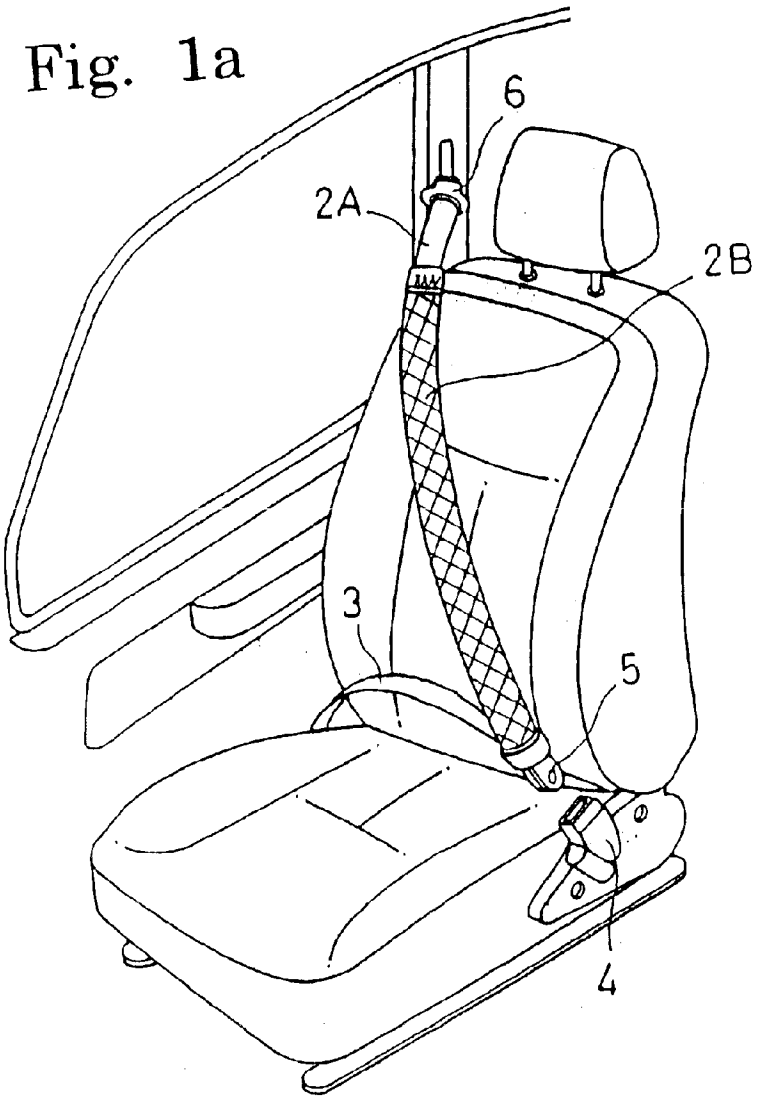
Figures 2A, 2B, 2C, 2D, 2E:
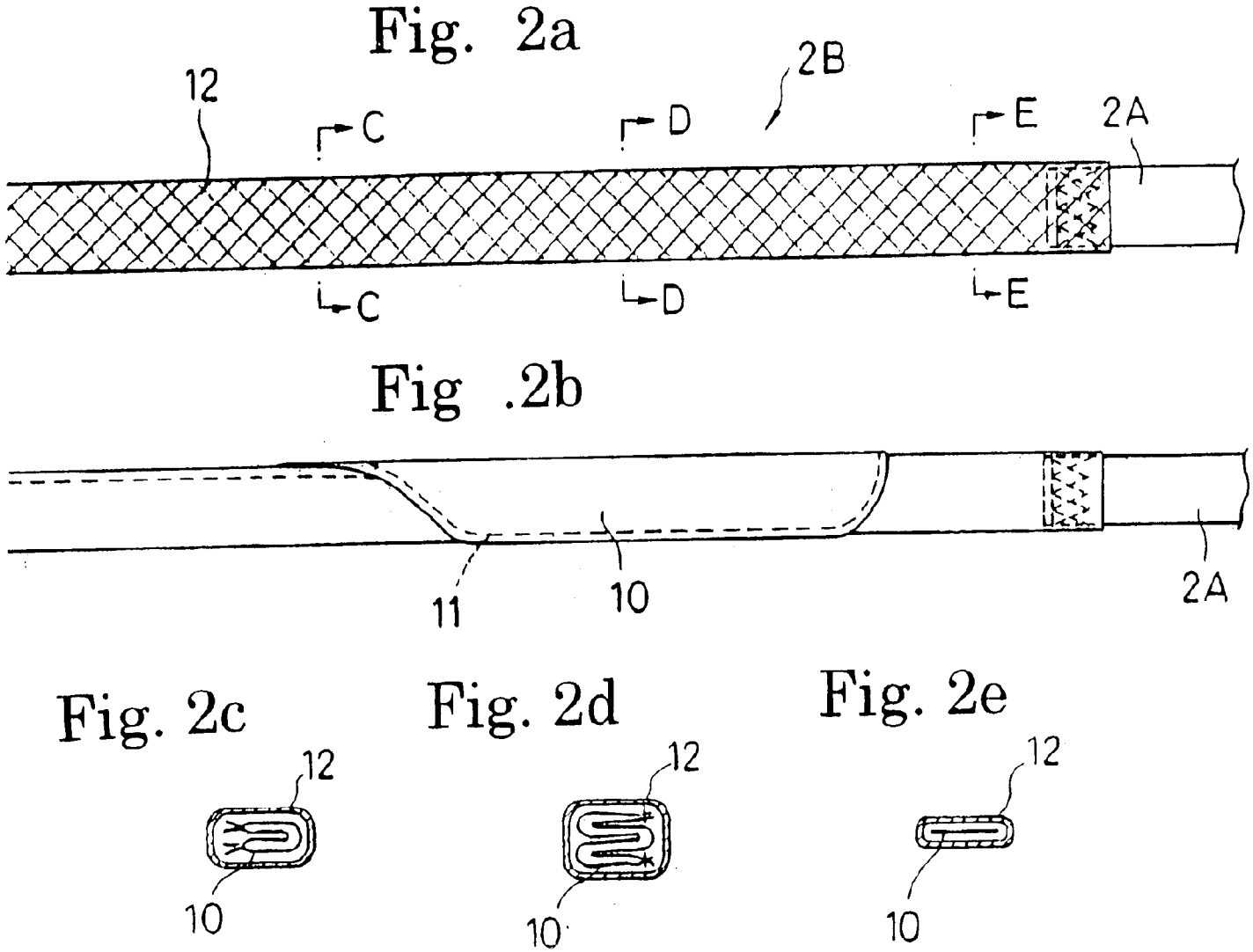
FIG. 2 illustrates the structure of the air belt.
Figure 3A:
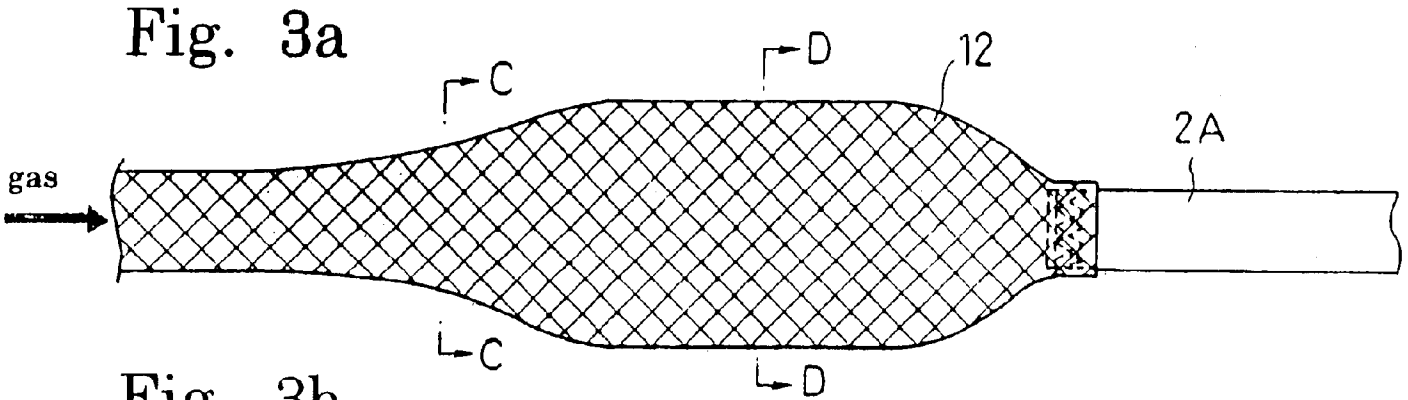
FIG. 3 illustrates the structure of the air belt when being inflated.
Figure 3B:
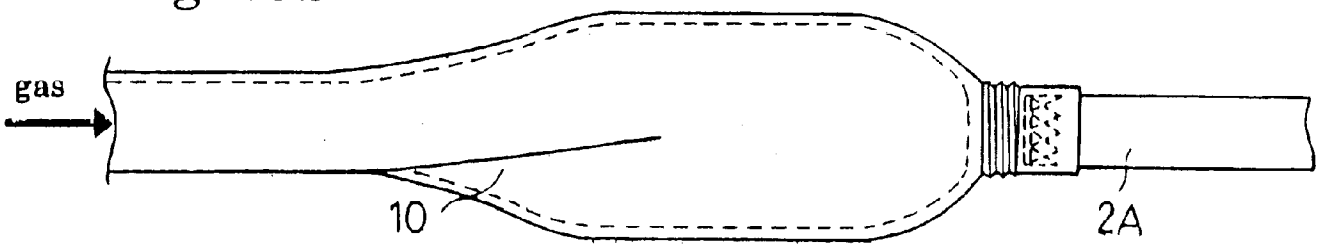
Figure 3C:
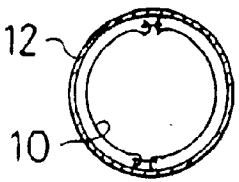
Figure 3D:
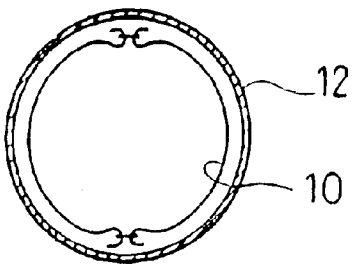
Figure 4A:
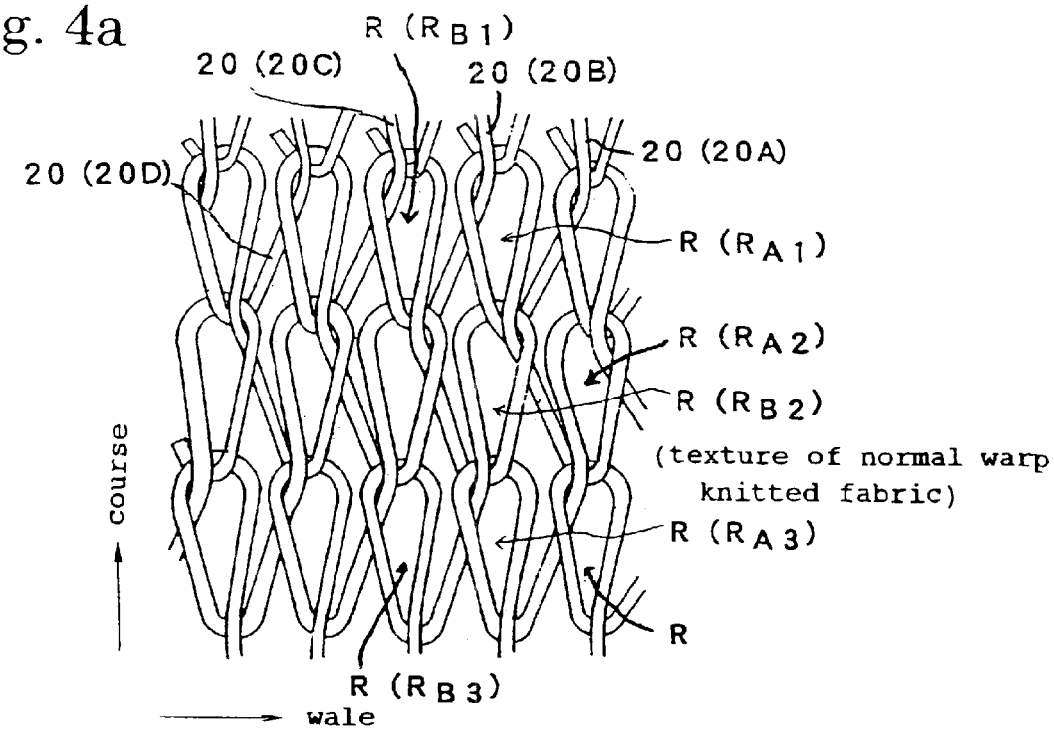
FIG. 4 illustrates how to knit the knit cover.
Figure 4B:
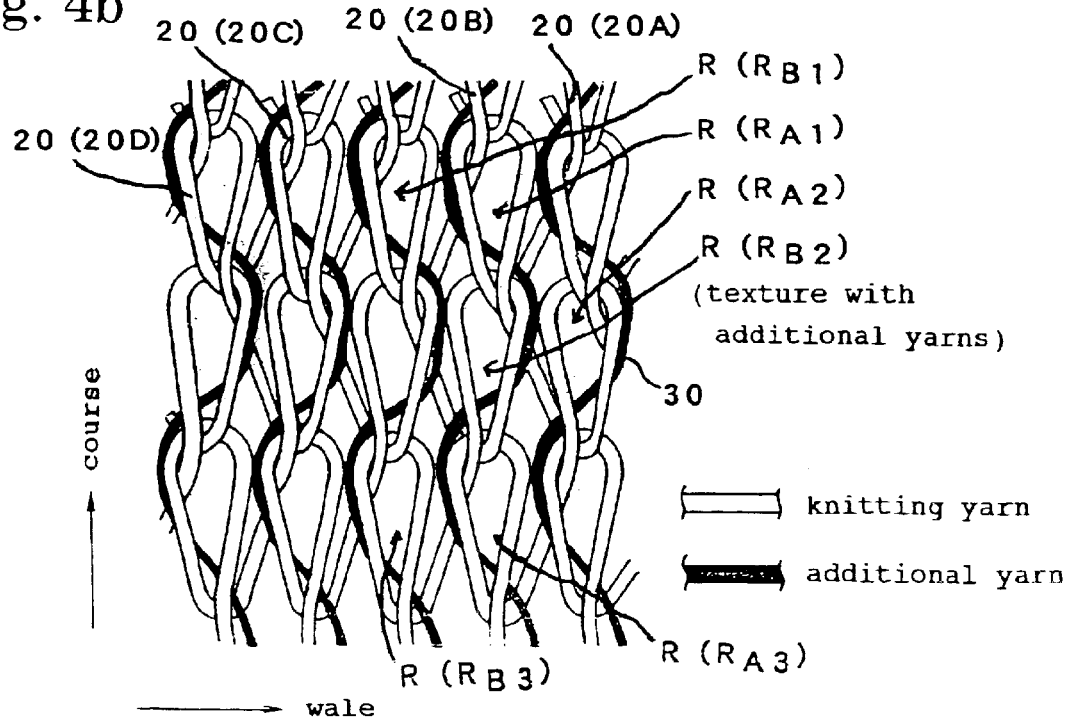
Figure 5:
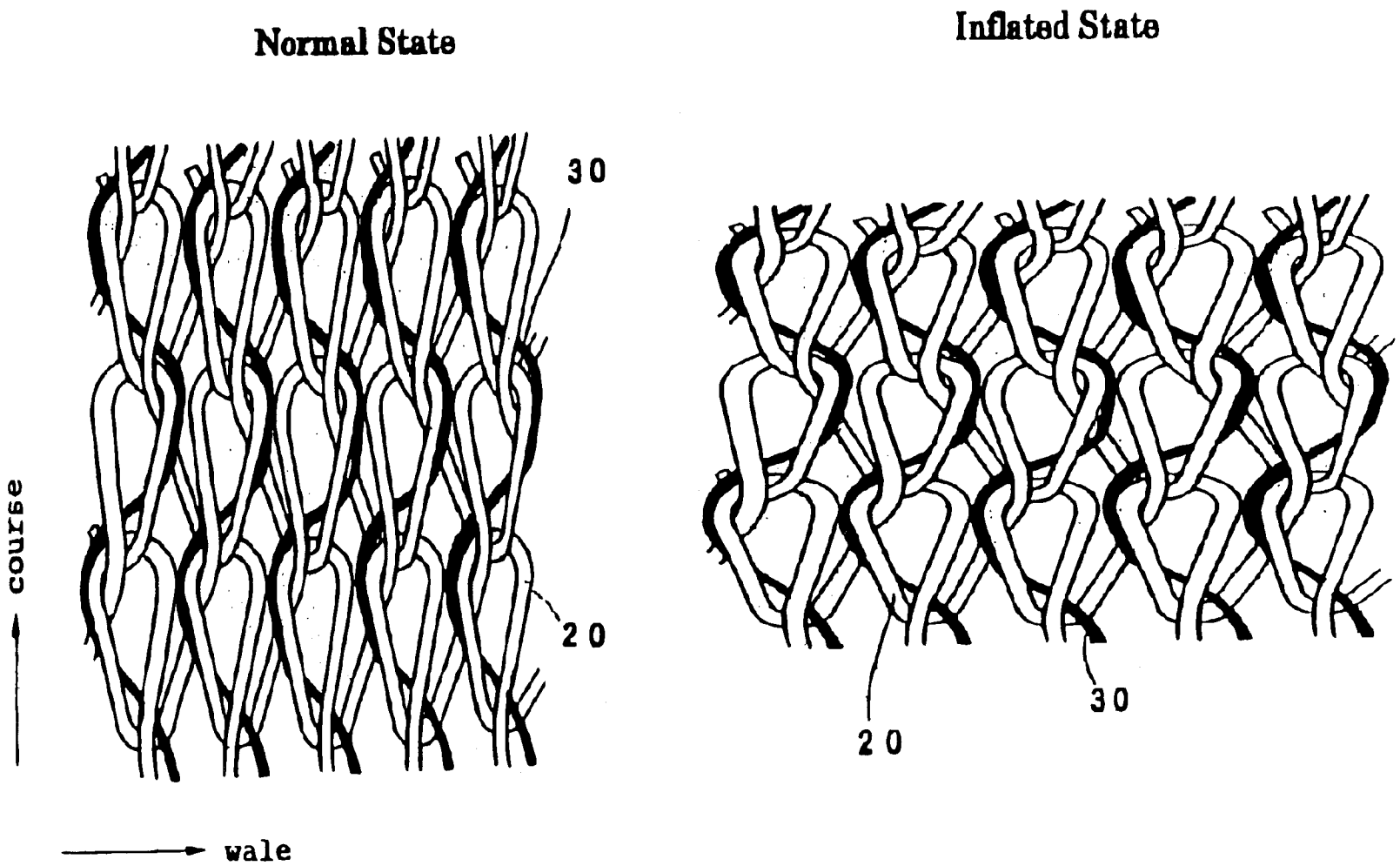
FIG. 5 are explanatory drawings illustrating the contrast between the air belt in the normal state and the air belt in a state of being inflated.

The warp knitted fabric for the air belt cover of the first aspect of the present invention comprises, as shown in FIG. 4*b* and FIG. 5, knitting yarns 20 for a normal warp knitted fabric and additional yarns 30 inserted therein. In a warp knitted fabric shown in FIG. 4*b* and FIG. 5 additional yarns are inserted along a series of loops arranged from top to bottom relative to the base fabric passing through the intersections of knitting yarns 20 alternately from the front to the back of the fabric and again from the back to the front thereon, and so on.

The additional yarn 30 used here is 3000 d or below in thickness, and the knitting yarn 20 is equivalent to or thinner than the additional yarn 30.

If the thickness of the additional yarn 30 exceeds 3000 d, the warp knitted fabric becomes thicker, and provides worse texture due to roughness of the knitted loops.

It is preferable to use yarns with the thickness ranging from 1000 to 3000 d as the additional yarn and from 250 to 1500 d, which is thinner than the additional yarn, as the knitting yarn.

The knitting yarn and the additional yarn (hereinafter referred to as constitutive yarns) are preferably made of thermoplastic synthetic filaments such as polyamide or polyester yarns having base yarn strength of at least 8.0 g/d.

If the strength of base yarn is lower than 8.0 d/g, sufficient strength for the air belt cover may not be expected. The base yarn strength of at least 9.0 g/d is specially preferable. Making the base yarn strength higher than 10 g/d is difficult due to the construction in denier, and therefore the most preferable strength of base yarn ranges from 9.0 to 9.5 g/d.

Preferably, the constitutive yarns are composed of fine filaments of 5 to 10 d, and more preferably, the additional yarns are composed of double yarns with the total thickness of 3000 d or below wherein each yarn is composed of 100 to 300 filaments of 5 to 10 d, and the knitting yarns are of smaller number in denier than that of the additional yarn and composed of yarns of 250 to 1500 d each of which is composed of 30 to 300 filaments of 5 to 10 d in thickness.

Preferably, the warp knitted fabrics for the air belt cover of the first and the second aspects of the present invention are subject to heat drawing processing using a heat set for elongation setting and width adjustment. Preferably, the number of additional yarns are determined by required tensile strength characteristics. Preferably, the warp knitted fabric is manufactured such that the thickness thereof is 1.0 to 2.0 mm, and that the tensile strength in the direction of the length (court) thereof caused by stretching in the direction of the width (wale) at 100 kPa (hereinafter referred to as "length control tensile strength")is between 200 and 600 kgf.

The first aspect of this invention will be described in further detail by way of examples.

EXAMPLES 1–3

The warp knitted fabrics of the structure illustrated in FIG. 4*b* and FIG. 5 were manufactured using knitting yarn and additional yarn (both are made of polyester) having the structures shown in the table 1, and were subjected to heat drawing processing by means of a heat set. Then, thickness, length control tensile strength, strength, and comfortableness thereof were investigated. As a result, in the embodiments 2 and 3 shown in Table 1, comfortableness with the belt fastened was very good, which means that the fabrics had soft feeling, and in embodiment 1, comfortableness was good, which means that the fabric had a bit harder texture than embodiments 2 and 3 but still soft enough.

According to Table 1, it will be understood that the warp knitted fabric for the air belt cover of this invention has good stretching characteristics, strength, comfortableness, and the balance of the combination thereof.

most row of loops. In this way, since the thin second additional yarn 40A spans directly between loops on the first row and loops on the third row, and another additional yarn 40B spans directly between loops on the third row and loops on the sixth row, the fabric is prevented from being stretched in transverse direction of the drawing due to spreading out of knitted loops (normal state in FIG. 6). When the fabric is subject to a force greater than the breakage strength of this thin second additional yarn 40, the thin additional yarn 40 breaks and allows the fabric to stretch in transverse direction (the directions of wale) due to spreading out of the knitted loops (inflated state in FIG. 6).

Preferably, the second additional yarn 40 is a thin yarn of 300 d or below. The second additional yarn 40 thicker than 30 d is not preferable because it may impede the inflation of the air belt. On the contrary, if the second additional yarn 40 is excessively thin, it may not sufficiently prevent the fabric from stretching in transverse direction when the air belt is not inflated. Therefore, the thickness of the second additional yarn 40 is preferably at least 30 d.

Especially, the second additional yarn is preferably made of thin thermoplastic ranging from 50 to 150 d in thickness with the base yarn strength of about 4.0 to 8.0 g/d.

In the second aspect of the present invention, the first additional yarn 30 and the knitting yarn 20 are preferably of the same type as the first aspect.

As hitherto described, the warp knitted fabric for the air belt cover is provided. The fabric has good stretching characteristics, strength, and comfort as the knit cover for the air belt system, and of which the knitted loops can hardly spread out when the air belt is not inflated are provided.

| | knitting yarn | | | | additional yarn | | | | warp knitted fabric | | | |
|---|---|---|---|---|---|---|---|---|---|---|---|---|
| Example | filament denier (d) | yarn denier (d) | base yarn strength (g/d) | presence of double yarn | additional filament denier (d) | additional yarn denier (d) | additional base yarn strength (g/d) | additional presence of double yarn | thickness (mm) | length control tensile strength (kgf) | strength | comfortableness |
| 1 | 5.2 | 1000 | 9.10 | no | 5.2 | 1500 | 9.15 | no | 1.7 | 387 | 23.7 kN | good |
| 2 | 5.2 | 500 | 8.95 | no | 5.2 | 1500 | 9.15 | yes | 1.7 | 550 | 42.7 kN | very good |
| 3 | 5.2 | 750 | 9.0 | no | 5.2 | 1000 | 9.10 | yes | 1.6 | 520 | — | very good |

Figure 6:
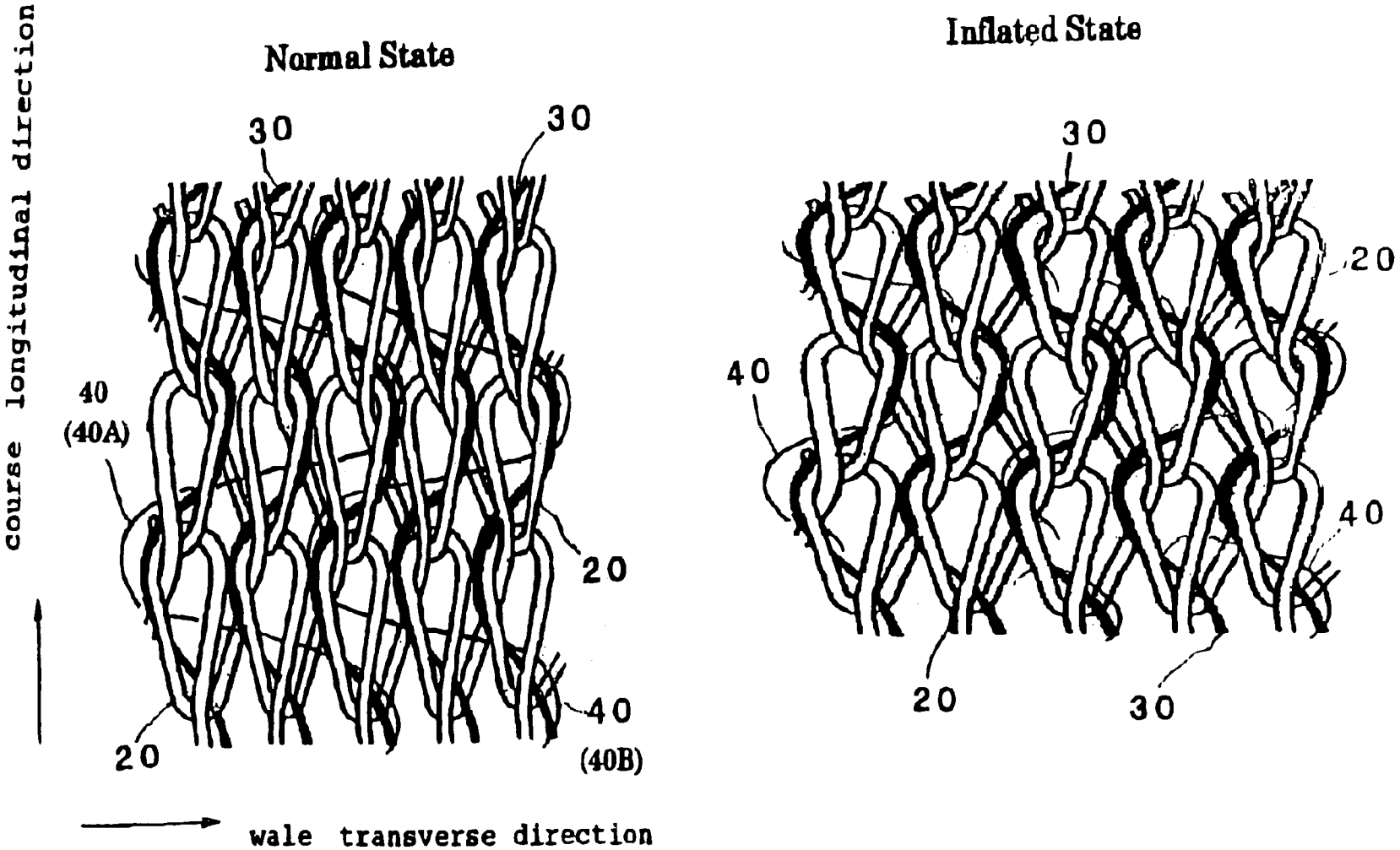
FIG. 6 illustrates how to knit the warp knitted fabric for the air belt cover of the second aspect of the present invention showing an embodiment thereof.

Referring now to FIG. 6, an embodiment of the second aspect of this invention will be described.

The warp knitted fabric illustrated in FIG. 6 further includes the second additional yarn 40 inserted into the warp knitted fabric which comprises a knitting yarn 20 and the additional yarn (the first additional yarn) 30 shown in FIG. 4*b* and FIG. 5.

In this warp knitted fabric, an additional yarn 30 is inserted along a series of loops arranged from top to bottom passing through the intersections of the knitting yarns 20 alternately from the front to the back of the fabric, and again from the back to the front thereof.

The second thin additional yarn 40 is inserted in such a manner that it binds three rows of loops together. In other words, as shown in FIG. 6, the thin second additional yarn 40A hooked on the left most row of loops is then hooked on the third row of loops from the left, and then hooked again on the left most row of loops. In the same way, the thin second additional yarn 40B which is hooked on the right most row of loops in FIG. 6 is next hooked on the third row of loops from the right, and then hooked again on the right This application is one of seven copending applications:

| U.S. Ser. No. | U.S. Filing Date | Our Docket No. | Japanese Application No. |
|---|---|---|---|
| 09/327,481 | Jun. 8, 1999 | 086142/0246 | H10-159293 |
| 09/327,451 | Jun. 8, 1999 | 086142/0247 | H10-159296 |
| 09/327,547 Now issued as U.S. Pat. No. 6,135,563 | Jun. 8, 1999 Issue Date Oct. 24, 2000 | 086142/0248 | H10-159295 |
| 09/327,546 | Jun. 8, 1999 | 086142/0249 | H10-159297 |

The instant application hereby incorporates by reference the entire specification including claims and abstract and the drawings of each of the other six applications.

I claim:

1. A warp knitted fabric for an air belt for enclosing a bag belt folded into a shape of a band and constituting an inflatable air belt comprising:

a knitting yarn; and an additional yarn inserted into the knitting yarn, wherein the additional yarn comprises:

a first additional yarn positioned to prevent the warp knitted fabric from stretching in the longitudinal direction; and a second additional yarn positioned to prevent the warp knitted yarn from stretching in the transverse direction, wherein the second additional yarn has a thickness less than the first additional yarn;

wherein when a sufficient force is applied to the second additional yarn to cause the second additional yarn to break the warp knitted fabric is thereby permitted to stretch in the transverse direction.

2. A warp knitted fabric for an air belt according to claim 1, wherein the knitting yarn is arranged in successive loops which engage with adjacent loops on both sides alternately, and wherein the first additional yarn is positioned to establish a link between closest loops of the knitting yarn, and wherein the second additional yarn is positioned to establish a link between the next closest loops.

3. A warp knitted fabric for an air belt according to claim 1, wherein the thickness of the second additional yarn is 3000 denier or below.

4. A warp knitted fabric for an air belt according to claim 2, wherein the thickness of the second additional yarn is 3000 denier or below.

5. A warp knitted fabric for an air belt according to claim 1, wherein the thickness of the first additional yarn ranges from 1000 to 3000, and the thickness of the knitting yarn is the same as or below that of the first additional yarn.

6. A warp knitted fabric for an air belt according to claim 2, wherein the thickness of the first additional yarn ranges from 1000 to 3000, and the thickness of the knitting yarn is the same as or below that of the first additional yarn.

7. A warp knitted fabric for an air belt according to claim 3, wherein the thickness of the first additional yarn ranges from 1000 to 3000, and the thickness of the knitting yarn is the same as or below that of the first additional yarn.

8. A warp knitted fabric for an air belt according to claim 1, wherein the knitting yarn and the first additional yarn are made of thermoplastic synthetic filament yarn of which the base yarn strength is at least 8.0 g/d.

9. A warp knitted fabric for an air belt according to claim 2, wherein the knitting yarn and the first additional yarn are made of thermoplastic synthetic filament yarn of which the base yarn strength is at least 8.0 g/d.

10. A warp knitted fabric for an air belt according to claim 3, wherein the knitting yarn and the first additional yarn are made of thermoplastic synthetic filament yarn of which the base yarn strength is at least 8.0 g/d.

11. A warp knitted fabric for an air belt according to claim 4, wherein the knitting yarn and the first additional yarn are made of thermoplastic synthetic filament yarn of which the base yarn strength is at least 8.0 g/d.

12. A warp knitted fabric for an air belt according to claim 5, wherein the knitting yarn and the first additional yarn are made of thermoplastic synthetic filament yarn of which the base yarn strength is at least 8.0 g/d.

13. An inflatable air belt including a cover, the cover comprising:

a knitting yarn configured into a warp knitted fabric;

a first additional yarn inserted into the fabric in a position to prevent the fabric from stretching a longitudinal direction;

a second additional yarn inserted into the fabric in a position to prevent the fabric from stretching in a transverse direction; and wherein the cover is configured so that when the air belt inflates sufficient force is applied to the second additional yarn to cause the second additional yarn to break thereby allowing the warp knitted fabric to stretch in the transverse direction.

14. The inflatable air belt of claim 13, wherein the knitting yarn is arranged in longitudinal rows of successive loops, each successive loop formed from knitting yarn from adjacent loops located on one side of the successive loop, wherein the successive loops are arranged so that the loops alternate the side on which the adjacent loops are located, and wherein the first additional yarn passes through the fabric in a longitudinal direction is positioned to establish a link between adjacent loops of the knitting yarn in the longitudinal direction; and wherein the second additional yarn passes through the fabric in the longitudinal direction and is positioned to establish a link between alternating loops of the knitting yarn in the transverse direction.

15. The inflatable air belt of claim 14, wherein the first additional yarn has a thickness of equal to or less than 3000 denier.

16. The inflatable air belt of claim 15, wherein the thickness of the second additional yarn is equal to or less than 300 denier.

17. The inflatable air belt of claim 15, wherein the thickness of the second additional yarn is greater than or equal to 30 denier and less than or equal to 300 denier.

18. The inflatable air belt of claim 15, wherein the thickness of the second additional yarn is greater than or equal to 50 denier and less than or equal to 150 denier.

19. The inflatable air belt of claim 15, wherein the second additional yarn comprises thermoplastic material.

* * * * *